United States Patent [19]

Wicks

[11] Patent Number: 5,055,335

[45] Date of Patent: Oct. 8, 1991

[54] WEATHERSTRIP FOR A JAMB AND CLOSURE MEMBER

[76] Inventor: Sidney G. Wicks, 294 Wildwood Park, Winnipeg, Manitoba, Canada, R3T 0E5

[21] Appl. No.: 484,266

[22] Filed: Feb. 26, 1990

[51] Int. Cl.[5] ..... E06B 7/098

[52] U.S. Cl. ..... 428/99; 49/314; 49/504

[58] Field of Search ..... 296/93; 49/314, 504; 428/99

[56] References Cited

U.S. PATENT DOCUMENTS

| | | | |
|---|---|---|---|
| 378,778 | 2/1888 | Dodge | 428/188 X |
| 1,352,732 | 9/1920 | Egerton | 428/188 X |
| 3,531,897 | 10/1970 | Weimar | 49/490 X |
| 3,818,960 | 6/1974 | Pozzi | 144/3 R X |
| 4,321,293 | 3/1982 | Naka | 428/99 X |
| 4,730,416 | 3/1988 | Eames | 428/122 X |

*Primary Examiner*—Henry F. Epstein

*Attorney, Agent, or Firm*—Adrian D. Battison; Stanley G. Ade; Murray E. Thrift

[57] ABSTRACT

A weather strip for attachment to a jamb for engagement of a flexible portion of the weather strip against a closure member for example a door comprises an attachment portion of rectangular shape for attachment to the jamb and a flexible portion of blade-shape or cylindrical shape for flexible engagement with the door. The attachment portion is formed of an exterior thin wall surrounding a hollow interior with the wall being coextruded with the flexible portion. The resultant body is thus relatively flimsy and is rendered rigid by the addition of a stiffener element inserted into the hollow interior defined by the walls.

10 Claims, 1 Drawing Sheet

FIG. 1
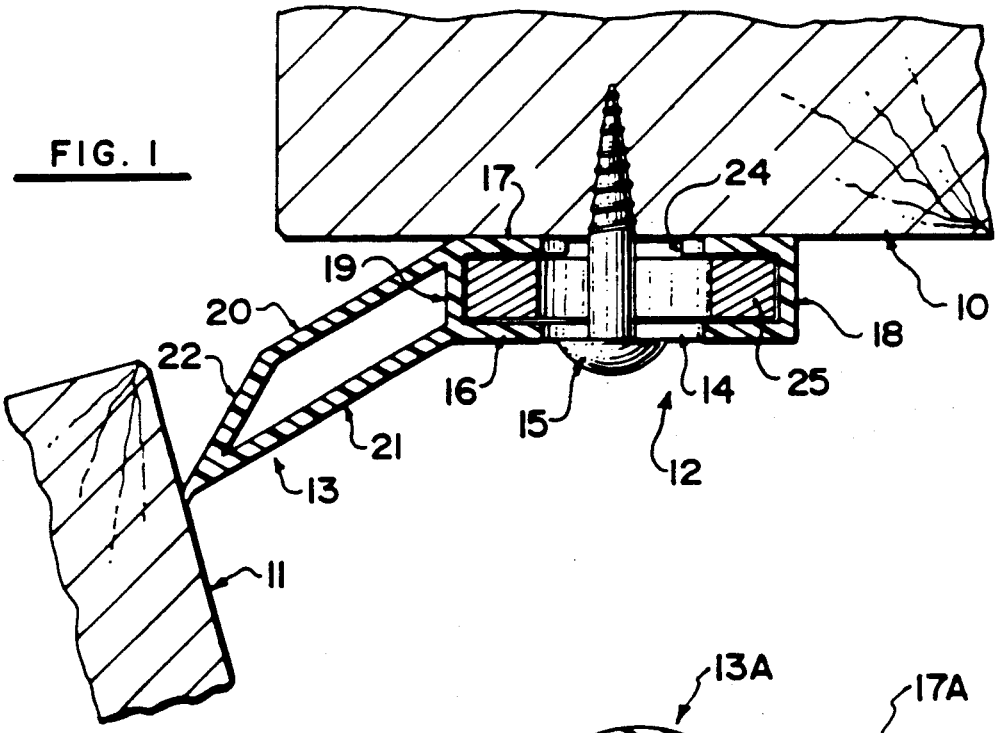
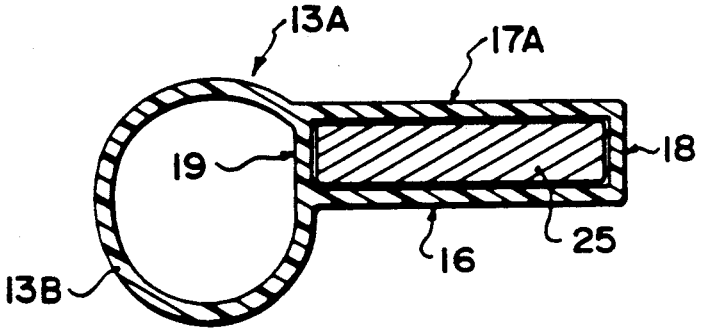
FIG. 2
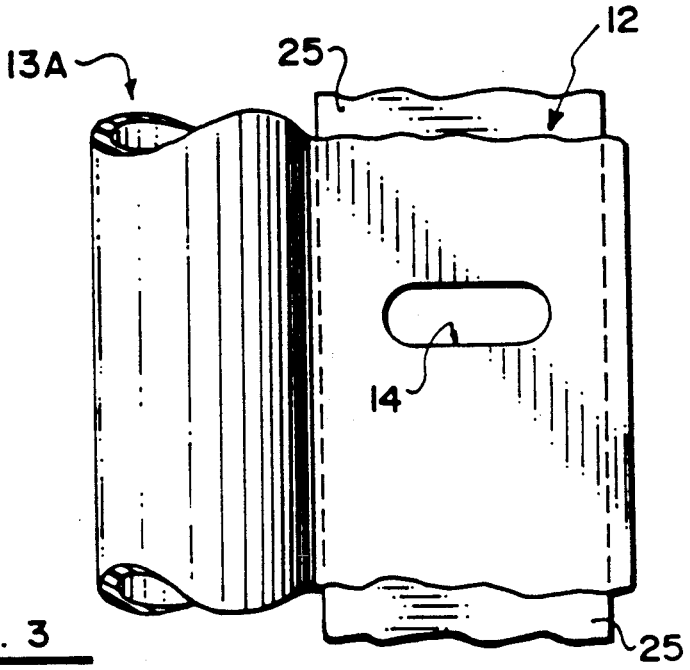
FIG. 3

WEATHERSTRIP FOR A JAMB AND CLOSURE MEMBER

BACKGROUND OF THE INVENTION

This invention relates to a weather strip of the type which comprises an elongate body having a strip portion which is substantially rigid for attachment to a jamb and a flexible portion which is carried by the strip portion and extends outwardly therefrom for engaging an element such as a door for closing against the jamb.

Conventionally the strip member is formed from a metal strip to which is attached a separately formed extruded plastics element formed preferably from a polymerized rubber material. The metal strip must be formed to receive an attachment portion of the flexible member so that generally the metal strip also must be an extruded profile. The costs of manufacturing therefore a product of this type are relatively high in that it involves two separate extrusions both of which are relatively complex. In addition the appearance of the product is less satisfactory in view of the fact that it includes two separate parts which have entirely different appearance characteristics with the metal generally providing a shiny metallic appearance and the extruded plastics material being of an entirely different colour and appearance. Thus when attached to the door jamb, the product provides merely a utilitarian appearance without any possibility for blending of the product into the colour scheme.

SUMMARY OF THE INVENTION

It is one object of the present invention, therefore to provide an improved weather strip of this general type including a strip portion for attachment to the jamb and a flexible portion for engagement of the closing element, for example the door.

According to the invention, therefore, there is provided a weather strip for attachment to a jamb so as to engage an element closable against a jamb, the weatherstrip comprising an elongate body defining a relatively stiff strip portion for attachment to the jamb and a flexible portion carried by the strip portion so as to project outwardly therefrom for engagement with the element, the strip portion comprising wall means surrounding at least a majority of a hollow interior and a stiffener element separate from the wall means and inserted into the hollow interior, the wall means and the flexible portion being co-extruded a common elongate extruded body.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 1 is a transverse cross-sectional view of a weather strip attached to a jamb.

FIG. 2 is a transverse cross-sectional view of a modified form of weather strip according to the invention.

FIG. 3 is a front elevational view of the weather strip of FIG. 2.

In the drawings like characters of reference indicate corresponding parts in the different figures.

DETAILED DESCRIPTION

A door jamb is indicated at 10 for cooperation with a door indicated at 11 which provides a closing action against the door jamb.

The weatherstrip comprises a substantially rigid strip portion 12 which is connected to and carries a flexible sealing portion 13. The strip portion 12 comprises an elongate rectangular body with a plurality of openings 14 each for receiving a screw fastener 15 by which the strip portion can be attached to the jamb 10. The openings 14 are elongate in a direction transverse to the length of the strip so the position of the strip can be adjusted in a side to side direction to increase or decrease the pressure of the flexible member 13 against the door 11.

The strip portion comprises four walls the first of which is indicated at 16 and the second of which is indicated at 17. The wall 16 and 17 are parallel. A third wall 18 and a fourth wall 19 are also parallel and lie at right angles to the walls 16 and 17. The spacing between the wall 16 and 17 is significantly less than that between the walls 18 and 19 so as to form a rectangular strip shaped body which has sufficient depth or thickness to provide the required degree of rigidity for the structure and is wide enough as shown in FIG. 3 to receive the elongate openings 14.

The flexible portion 13 is directly connected to the third wall 19 so that it defines two wall portions 20 and 21 which project outwardly from the wall 19 and define with the wall 19 a hollow interior. In the embodiment of FIG. 1 the flexible member comprises a blade defined by the parallel walls 20 and 21 together with a converging wall portion 22 which converges towards the wall 21 and defines therewith an apex for engaging the door so that the whole flexible portion acts as a blade which can flex or twist in an anti-clockwise direction as shown in FIG. 1.

In FIG. 2 the flexible portion indicated at 13A comprises an annular wall 13B which connects with the wall 19 and forms therewith a hollow cylindrical interior which can be compressed by engagement with the door 11.

In FIG. 1 the second wall 17 lying against the face of the jamb includes an opening 24 along the full length thereof defining a slot. This allows a slight flexing apart of the walls so that a stiffening element 25 can be inserted into the hollow interior between the walls. The stiffening element is separate from the walls and is inserted as a sliding fit inside the walls with the flexibility of the part provided by the slot 24 allowing the stiffening element easily longitudinally of the part.

In FIG. 2 substantially the same structure is provided except that the wall indicated at 17A includes no slot so the four walls 17A, 18, 19 and 16 fully surround and wholly enclose the rectangular hollow interior for receiving the stiffening element 25.

The stiffening element 25 is formed of a relatively rigid material in a simple rectangular form and hence the stiffening element may be simply a metal strip or may be an extruded plastic strip of a relatively rigid inexpensive plastics material.

The walls defining the strip portion and the walls defining the flexible portion are coextruded as an integral plastics extrusion to form an integral body. One preferred example of material which can be used is polymerized rubber. This material has the desirable qualities that it remains flexible at very low temperatures and of course the weather strip is particularly required at such low temperatures.

An arrangement of FIG. 2, the whole of the product including the cylindrical wall and the rectangular walls can be molded from a single grade of the polymerized rubber material which is relatively flexible and is suitable to define the cylindrical flexible portion. The total stiffness of the strip portion is then defined by the inserted stiffener 25 and the flexibility and stretch of the rectangular wall surrounding the hollow interior allows the insert to slide into place without difficulty.

In the embodiment of FIG. 1, the rectangular walls including the wall 19 are preferably formed from a stiffer grade of the material while the flexible portion 13 is formed of a more resilient grade of the material. These materials can be coextruded from two separate extrusion pumps through a single die so that the materials form integrally into the integrally molded body. The use of the more rigid material allows the slot to be provided while the structure of the hollow interior remains substantially rectangular. Of course the wall 17 is maintained in fixed position rearwardly of the stiffener strip 25 by the compressive action of the fasteners pulling the strip portion against the face of the jamb.

As the stiffener member is formed of the relatively rigid material, it is necessarily stiffer or more rigid than the flexible portion and in the embodiment in which the walls are formed from the same grade of material, the stiffener member is necessarily more rigid from the co-extruded body defined by the walls and the flexible portion and therefore provides the majority of the stiffness of the completed element.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A jamb and closure element assembly comprising a jamb, a closure element movable relative to the jamb from an open to a closed position and a weather strip attached to the jamb so as to engage the closure element in the closed position against the jamb, the weatherstrip comprising an elongate body defining a relatively stiff strip portion attached to the jamb and a flexible portion carried by the strip portion so as to project outwardly therefrom into engagement with the element, the strip portion comprising wall means surrounding at least a majority of a hollow interior and a stiffener element separate from the wall means and inserted into the hollow interior, the wall means and the flexible portion being co-extruded as a common elongate extruded body, the stiffener element being formed of a material which is of greater rigidity than that of the flexible portion.

2. The invention according to claim 1 wherein the wall means includes an opening therein defining a slot along the length of the strip portion, the slot being arranged along a side of the strip portion for fastening onto a face of the jamb.

3. The invention according to claim 1 including a plurality of holes formed through the wall means and the stiffener element for screw fastening of the strip portion to the jamb.

4. The invention according to claim 1 wherein the stiffener element consists of an elongate body of constant external shape in transverse cross-section.

5. The invention according to claim 1 wherein the wall means fully encloses a hollow rectangular area.

6. The invention according to claim 1 wherein the wall means is formed from a more rigid plastics material and the flexible portion is formed from a more flexible plastics material, the wall means and the flexible portion being co-extruded.

7. The invention according to claim 1 wherein the flexible portion has a hollow interior at a point of contact thereof with the closure member allowing flexibility of the flexible portion.

8. The invention according to claim 1 wherein the wall means and the flexible portion are co-extruded from polymerized rubber.

9. The invention according to claim 3 wherein the holes are elongated in a direction transverse to the length of the strip.

10. The invention according to claim 1 wherein the majority of the stiffness of the weather strip is provided by the stiffener element.

* * * * *